United States Patent [19]

Eberhardt

[11] 4,351,391

[45] Sep. 28, 1982

[54] HEAT EXCHANGER FOR WATER PUMPING SYSTEM

[75] Inventor: H. Alfred Eberhardt, Paoli, Pa.

[73] Assignee: Hale Fire Pump Company, Conshohocken, Pa.

[21] Appl. No.: 151,278

[22] Filed: May 19, 1980

[51] Int. Cl.[3] ..... F28D 7/10

[52] U.S. Cl. ..... 165/154; 165/51; 165/164

[58] Field of Search ..... 165/51, 154, 157, 159, 165/160, 164

[56] References Cited

U.S. PATENT DOCUMENTS

| | | | |
|---|---|---|---|
| 1,983,466 | 12/1934 | Kline | 165/154 |
| 2,661,934 | 12/1953 | Stutz | 165/154 |
| 4,256,170 | 3/1981 | Crump | 165/154 |

FOREIGN PATENT DOCUMENTS

| | | | |
|---|---|---|---|
| 501900 | 4/1920 | France | 165/154 |
| 351990 | 3/1961 | Switzerland | 165/154 |
| 349234 | 1/1931 | United Kingdom | 165/154 |
| 562864 | 7/1944 | United Kingdom | 165/154 |

*Primary Examiner*—Albert W. Davis, Jr.
*Assistant Examiner*—Margaret A. Focarino
*Attorney, Agent, or Firm*—Harding, Earley & Follmer

[57] ABSTRACT

A heat exchanger for cooling engine coolant is arranged to use the main pump water flow as the cooling medium, is located on the suction side of the main pump, and is constructed of a finned casting with fins extending from a tubular portion of the casting body into a heat exchange chamber.

6 Claims, 7 Drawing Figures

HEAT EXCHANGER FOR WATER PUMPING SYSTEM

BACKGROUND AND SUMMARY OF THE INVENTION

A major problem in the operation of pumping systems, such as irrigation pumping systems, wherein the liquid being pumped contains substantial amounts of contaminant particles, is the difficulty in cooling the engine driving the main pump by using the liquid being pumped by the main pump. This problem exists between the contaminant particles in the liquid being pumped clog up the heat exchange passages of the conventional heat exchangers or similar cooling devices in use today. Also, ordinary radiator type engine cooling means use a fan to pass cooling air over the engine's coolant, which arrangement involves a substantial drain of power to drive the fan resulting in substantial energy consumption during operation of the system.

The heat exchanger design in accordance with the present invention for use with water pumping systems provides a solution to the above-discussed problems, and a substitute for and improvement over the conventional radiator type of engine cooling means.

Briefly stated, the heat exchanger design of the present invention comprises an elongated casting having an inlet opening at one end and a discharge opening at the other, the casting including a tubular portion extending between the inlet and discharge openings for defining a first heat exchange chamber internally of the tubular portion. A cover means spaced apart from and enclosing the tubular portion cooperates therewith to define a second heat exchange chamber externally of the tubular portion. There are provided suitable inlet means through which liquid to be cooled may be supplied to the external heat exchange chamber and outlet means through which this liquid may be discharged. In accordance with a novel feature of the invention, the tubular portion is provided with fins cast thereon to extend into both the first and the second heat exchange chambers, there being a plurality of such fins extending generally longitudinally of the tubular portion on both the inside and outside thereof to provide an effective heat exchange action.

There is also provided a novel water pumping system which comprises a water pump having a suction and discharge and arranged to draw water from a supply thereof to the suction and deliver water through the discharge, a water cooled engine arranged to drive the pump, a heat exchanger having a first heat exchange chamber for the cooling medium and a heat exchange chamber for the medium to be cooled. There is also provided conduit means for delivering the water drawn from the water supply to the first heat exchange chamber and from the heat exchanger to the suction of the pump and conduit means for circulating the cooling water of the engine through said second heat exchange chamber.

An advantage of the heat exchanger design in accordance with the invention is that it provides for compactness with no restriction of the main flow and a substantial amount of heat exchange area and thermal flow in a very small space. Moreover, the fins extending into the chamber for the liquid to be cooled extend longitudinally of the tubular portion and cooperate with the cover to provide a plurality of flow conduits providing a minimum of friction loss. The fins extend the effective surface of the tubular portion to give a large heat exchange surface without restricting the longitudinal flow of the liquid through the heat exchanger.

With the water pumping system in accordance with the invention wherein the heat exchanger is located on the suction side of the water pump, it is easy to provide the necessary sealing for the flow because of the low pressures present at this location. Moreover, the design and manufacture of the parts is simplified because there is no problem of withstanding high pressures. Another feature of the pumping system in accordance with the invention is that by eliminating the need for a fan to cool the engine water, all of the horsepower output is put to work pumping water, and there is no consumption of energy for driving a fan or similar cooling device.

DETAILED DESCRIPTION OF THE PREFERRED EMBODIMENT

Figure 1:
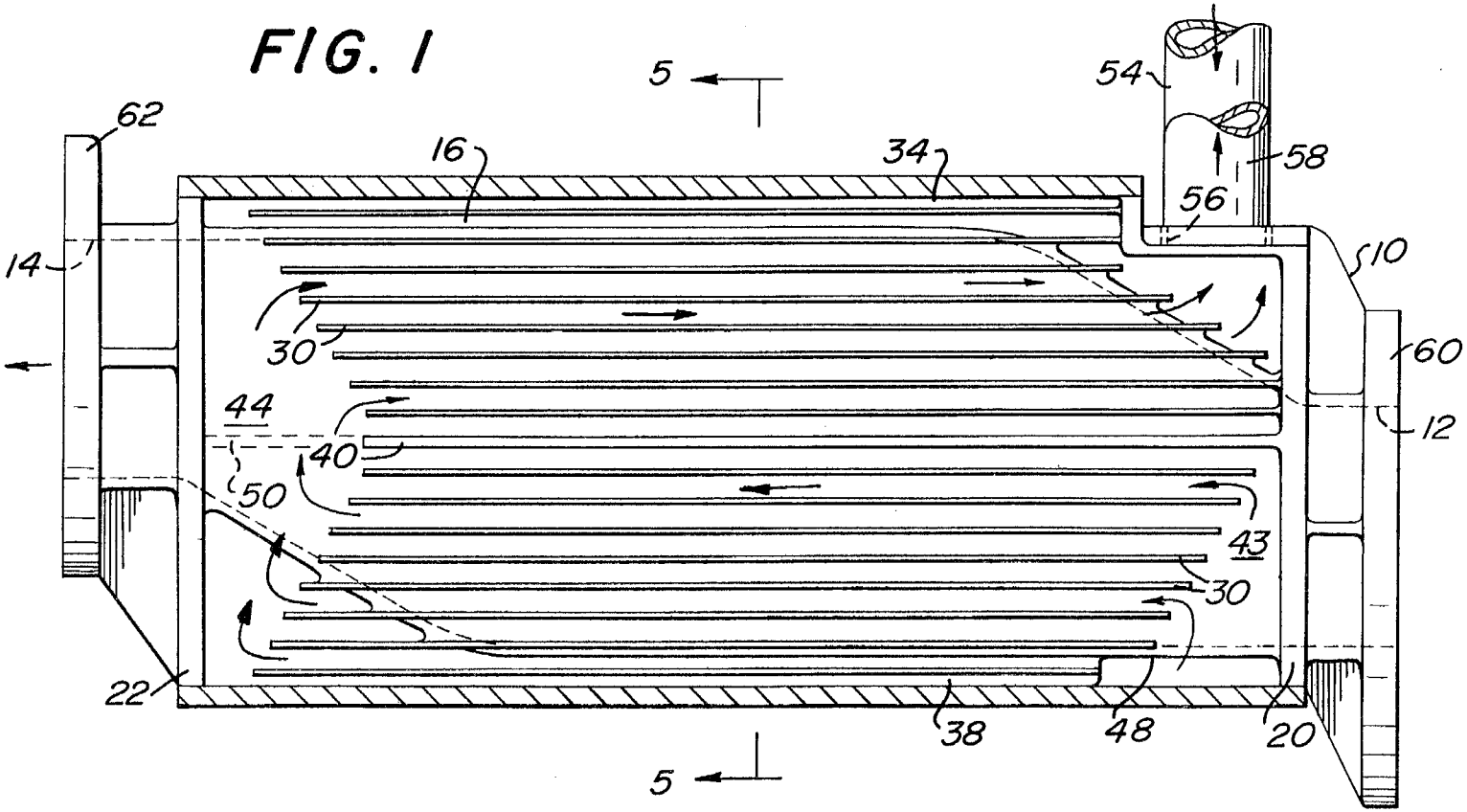
FIG. 1 is an elevation, partly in section, of one side of the heat exchanger in accordance with the invention.
Figure 2:
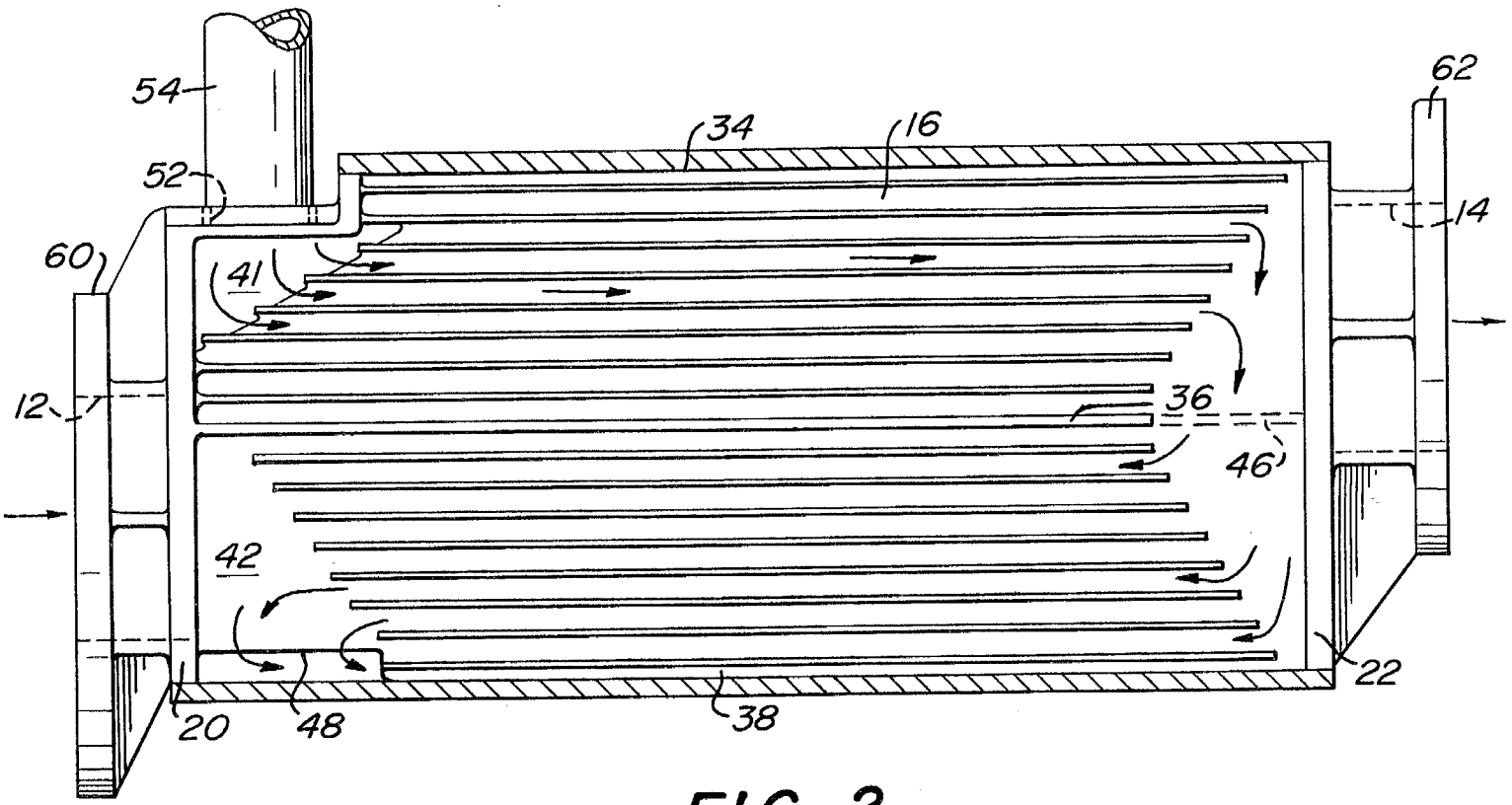
FIG. 2 is an elevation, partly in section, of the other side of the heat exchanger shown in FIG. 1.
Figure 5:
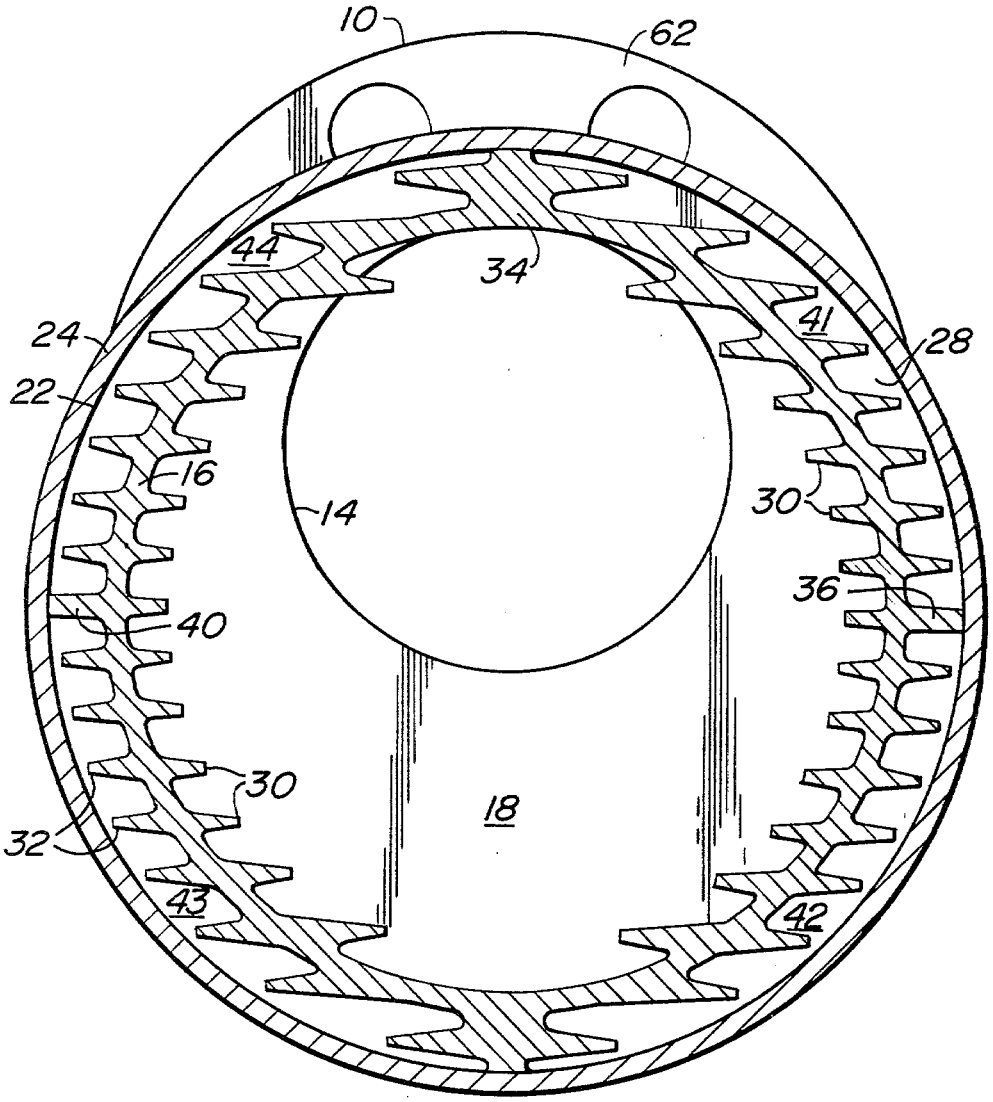
FIG. 5 is a sectional view taken on line 5—5 of FIG. 1.

A heat exchanger in accordance with the invention is shown in detail in FIGS. 1–5 and comprises an elongated casing 10 preferably made of aluminum so as to provide a light-weight construction. Casting 10 has an input opening 12 at one end thereof and a discharge opening 14 at the other end thereof. Casting 10 includes a tubular portion 16 extending between openings 12 and 14 to define an internal heat exchange chamber 18. As is shown in FIGS. 1, 2 and 5, inlet opening 12 and discharge opening 14 are offset relative to one another and relative to the longitudinal axis of casting 10 with chamber 18 being shaped to accomodate this offset. By this design, liquid flowing from inlet opening 12 to discharge opening 14 through chamber 18 is caused to flow upwardly when the heat exchanger is mounted in a horizontal position since discharge opening 14 is higher than inlet opening 12 in this case. The purpose of this design is to eliminate air traps and facilitate better priming and draining. Chamber 18 is self-draining to prevent freezing up of the heat exchanger.

Casting 10 is provided with a pair of end flanges 20 and 22 adjacent openings 12 and 14, respectively. Flanges 20 and 22 extend radially outwardly beyond tubular position 16 to provide circular seats for a tubular cover 24. Cover 24 is wrapped around tubular portion 16 to be spaced apart therefrom and to enclose the same. Cover 24 cooperates with tubular portion 16 to define a generally angular heat exchange chamber 28 externally of tubular portion 16.

Figure 3:
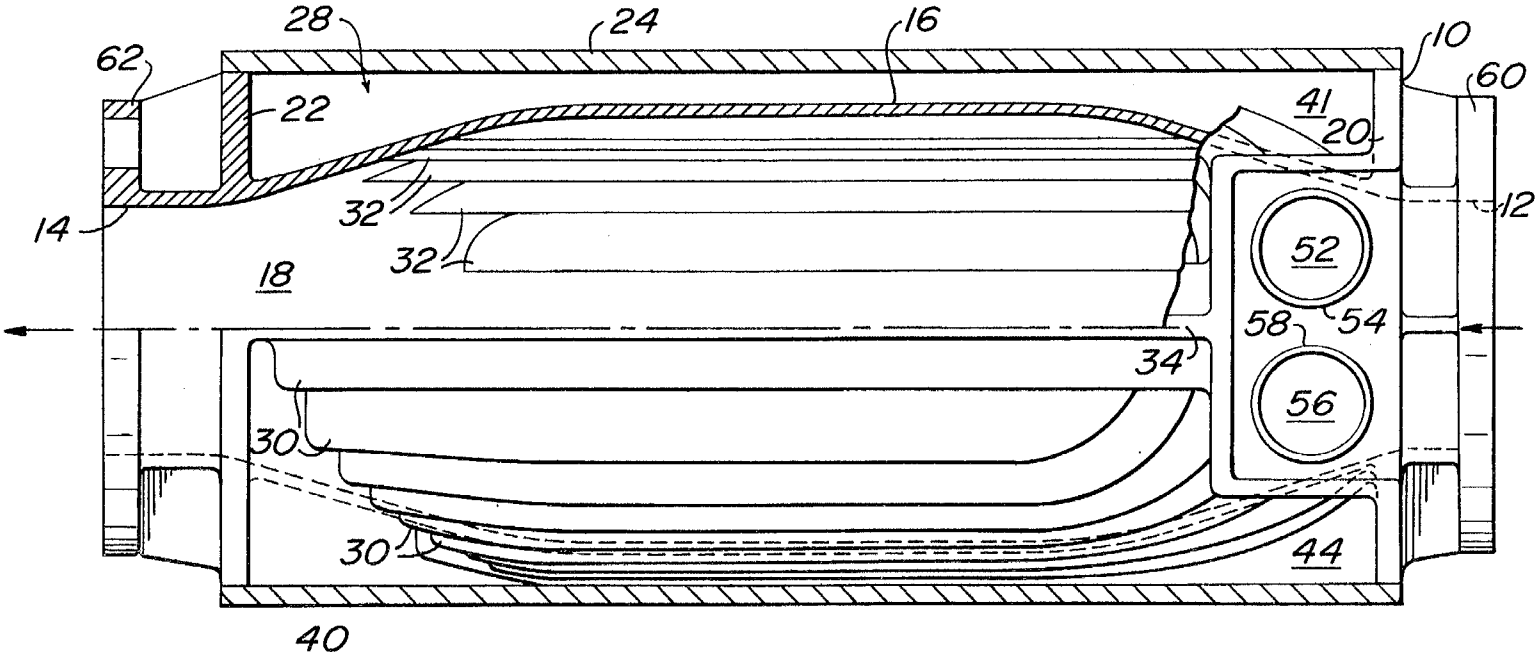
FIG. 3 is a top view of the heat exchanger shown in FIG. 1 broken away at various locations for illustrative purposes.
Figure 4:
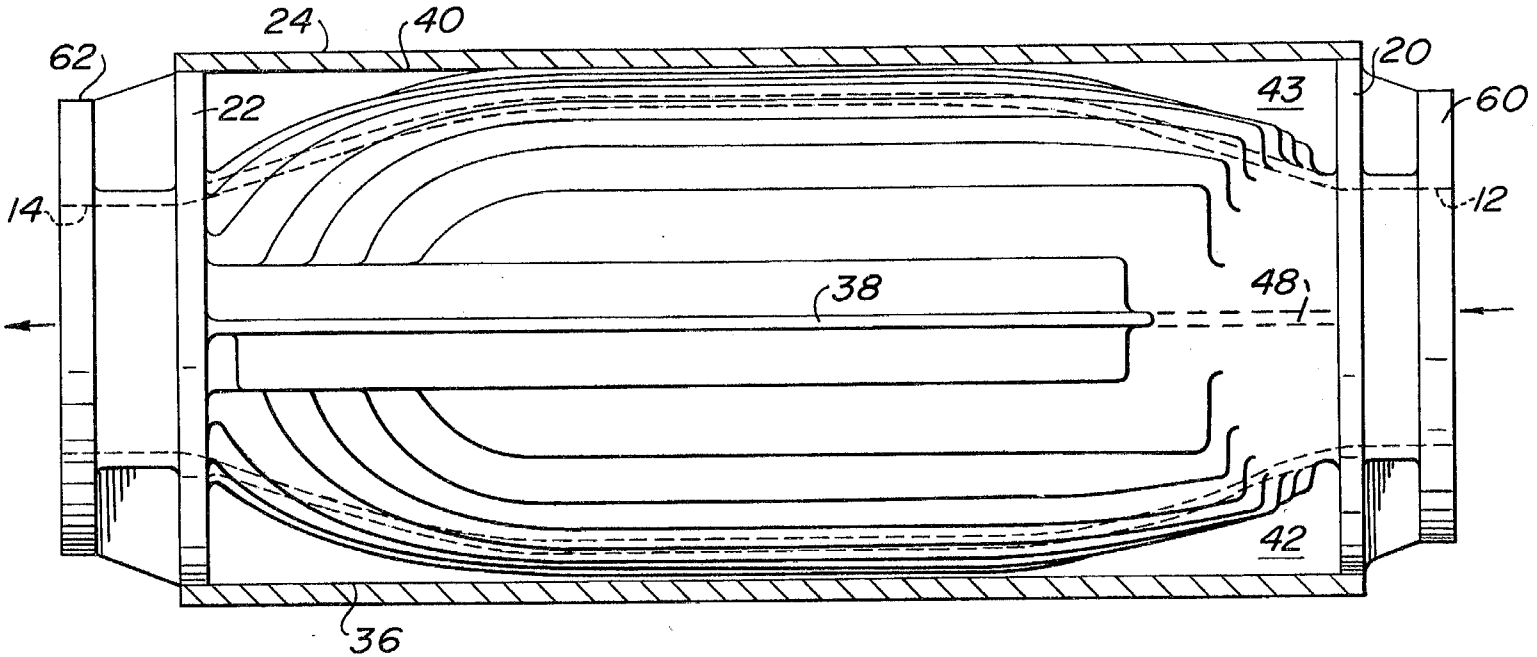
FIG. 4 is a bottom view of the heat exchanger shown in FIG. 1 broken away at various locations for illustrative purposes.

Tubular portion 16 is provided with internal fins 30 cast thereon to extend therefrom into chamber 18 as is shown in FIGS. 3 and 5. Fins 30 extend longitudinally of tubular portion 16 in spaced apart parallel relation. Tubular portion 16 is also provided with external fins 32 cast thereon to extend outwardly therefrom into annular chamber 28. Fins 32 are in alignment with fins 30 and extend longitudinally of tubular portion 16 in spaced apart parallel relation. By this construction and arrangement, fins 32 cooperate with cover 24 to define a plurality of parallel, longitudinally extending conduits for the flow of liquid as will be described more fully hereafter.

Tubular portion 16 is provided with four radially extending ribs or divider wall portions 34, 36, 38 and 40 circumferentially spaced equally around the periphery of tubular portion 16 and extending radially outwardly into contact with cover 24. Wall portions 34–40 divide annular chamber 28 to four flow compartments 41, 42, 43 and 44 each extending longitudinally of tubular portion 16 and occupying one quarter of annular chamber 28. There are provided three crossover ports 46, 48 and 50 arranged to provide flow communication between adjacent flow compartments. Crossover port 46 is located adjacent discharge opening 14 and provides flow between the ends of flow compartments 41 and 42. Crossover port 48 is located adjacent inlet opening 12 and provides flow communication between the ends of flow compartments 42 and 43. Crossover port 50 is located adjacent discharge opening 14 and provides flow communication between the ends of flow compartments 43 and 44. It will be apparent that the construction and arrangement of the crossover ports 46, 48 and 50 is such that liquid flowing through annular chamber 28 makes four passes back and forth along tubular portion 16 as the liquid flows sequentially through the four flow compartments 41, 42, 43 and 44.

There is provided an inlet means through which a liquid to be cooled in the heat exchanger may be supplied to the annular heat exchange chamber 28. Such means comprises an inlet port 52 formed in an upper portion of casting 10 to communicate with one end of flow compartment 41 at a location near inlet opening 12. A tubular inlet fitting 54 is mounted in port 52 for supplying liquid to be cooled thereto.

There is provided outlet means through which the liquid to be cooled by the heat exchanger is discharged from chamber 28. Such means comprises an outlet port 56 formed in casting 10 adjacent to port 52 to communicate with flow compartment 44 at a location adjacent inlet opening 14. A tubular outlet fitting 58 is mounted in port 56 for discharging liquid from flow compartment 44.

In the use of the heat exchanger shown in FIGS. 1–5, the heat exchanger is mounted in a horizontal position by means of mounting flanges 60 and 62 at the ends thereof. The cooling liquid is directed to flow longitudinally through the internal heat exchanger chamber 18 from inlet opening 12 to discharge opening 14. This liquid flows in intimate contact with internal fins 30 which extend longitudinally of the direction of flow. The liquid to be cooled is supplied through fitting 54 into the end of flow compartment 41 and flows away from the inlet opening 12 and then through crossover port 46 into flow compartment 42 (see FIG. 2). The liquid flows through flow compartment 42 back toward inlet opening 12 and through the crossover passage 48 (see FIG. 2) from which it flows into flow compartment 43 (see FIG. 1). The liquid then flows longitudinally through flow compartment 43 in the direction away from inlet opening 12 and then passes through crossover passage 50 into the end of flow compartment 44 (see FIG. 1). The liquid flows back toward the inlet opening 12 and enters the discharge opening 56 and is discharged from the heat exchanger by way of conduit 58 (see FIG. 1).

As the liquid to be cooled is flowing back and forth through the flow compartments 41, 42, 43 and 44, it passes through the small parallel flow conduits defined by the external fins 32. This arrangement helps to minimize the friction loss of the liquid flowing through the flow compartments 41–44.

As is shown in FIG. 2, the fins 32 in flow compartments 41 and 42 are cut back or relieved, in the area of crossover passage 46. This relief design serves to minimize the friction loss of the liquid as it turns to pass between the flow compartments 41 and 42. A similar relief construction is used in the area of crossover port 48 (see FIGS. 1 and 2) and in the area of crossover port 50 (see FIG. 1). The fins are relieved gradually at an angle of about 60° with the associated wall portions 34–40 in the area of the crossover passage involved.

A feature of the heat exchanger design is the minimization of the friction losses of the liquid flow. To this end, the design involves little restriction to the main flow through chamber 18. Also, the parallel, longitudinal arrangement of both fins 30 and 32 reduces the restriction to flow. The relief at crossover passages 46, 48 and 50 minimizes the friction losses at these locations.

In order to illustrate the dimensions of a typical heat exchanger in accordance with the invention, the heat exchanger shown in FIGS. 1 to 5 is approximately three feet in length and one foot in diameter. With the design in accordance with the invention, there is provided a very large heat transfer area in a relatively short space.

Figure 5A:
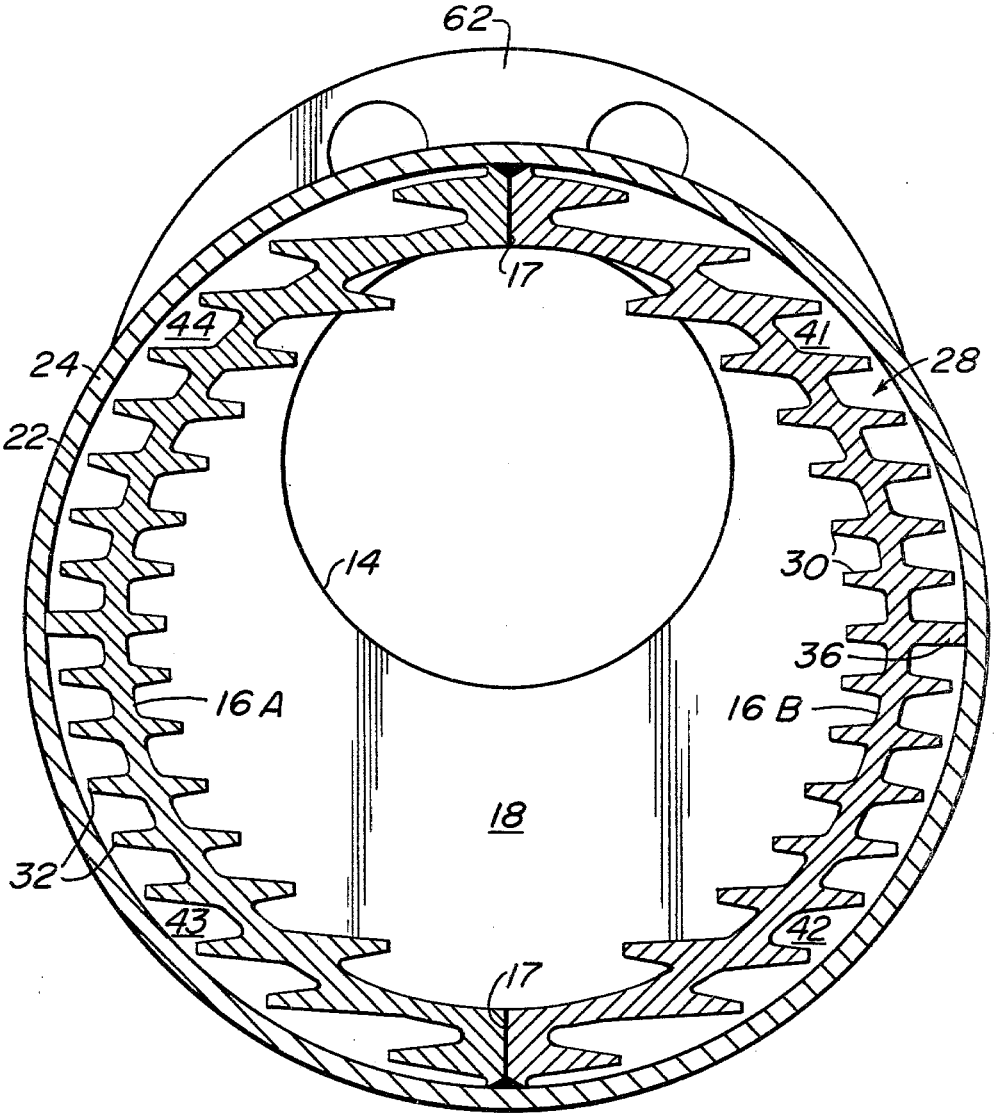
FIG. 5A is a sectional view similar to FIG. 5 of another construction of the elongated casting used in the heat exchanger in accordance with the invention.

It is to be noted that while the casting 10 is preferably made in one piece, this casting could be made in sections and bolted together or otherwise joined. In FIG. 5A there is shown a modified design in which the finned tubular portion is made of two half sections 16A and 16B welded together at longitudinally extending welds 17. In this design the flanges 60 and 62 are made of separate parts welded to the ends of the half sections 16A and 16B after these are welded together.

Figure 6:
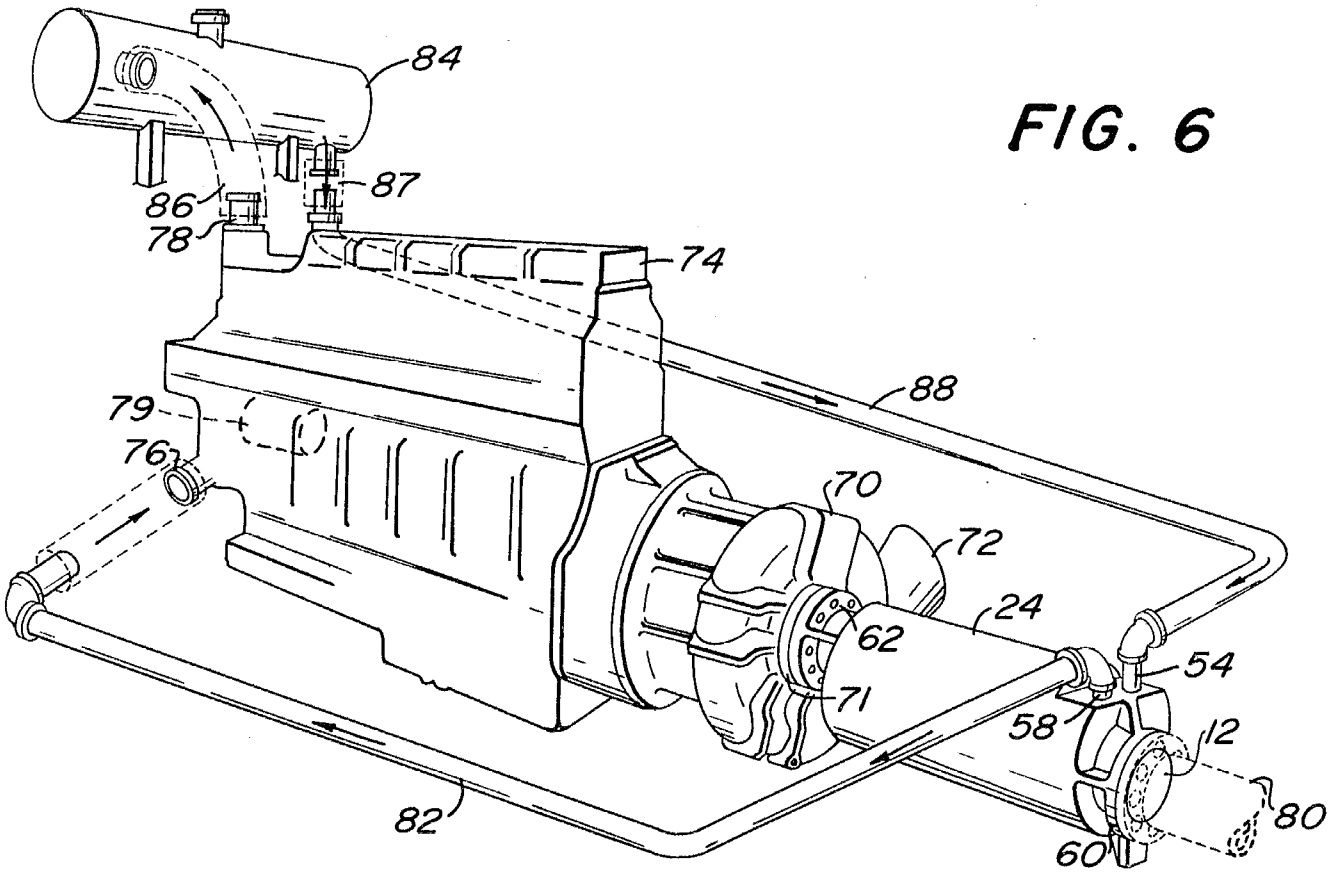
FIG. 6 is a perspective view of the water pumping system in accordance with the invention.

A water pumping system in accordance with the invention is shown in FIG. 6. This system is particularly adapted for service as an irrigation pumping system and comprises a main pump 70 which is arranged to deliver the water used for irrigation purposes through a pump discharge 72. Pump 70 is driven by a water-cooled diesel engine 74 mounted adjacent one end of pump 70. A heat exchanger as shown in FIGS. 1–5 is mounted on the other end of pump 70 with the mounting flange 62 being secured, as by bolts, to a compatible mounting plate 71 for pump 70. The heat exchanger is mounted in a horizontal position with its discharge opening 18 communicating with the suction of pump 70 so that the pump 70 is arranged to draw water from a supply thereof to the pump suction through the internal heat exchange chamber 18 of the heat exchanger and to discharge the water through the pump discharge 72.

Engine 74 is provided with a water-cooled region as is conventional comprising passages through which the engine coolant water flows. Engine 74 comprises a coolant inlet 76 at a bottom portion thereof and a coolant water outlet 78 at an upper portion thereof. A conventional water pump 79 is also provided.

Suitable conduit means are provided for delivering the water drawn from the water supply to the heat exchanger chamber 18 from which the water flows to the suction of pump 70. Such conduit means includes a supply conduit 80 connected to the mounting flange 60 of the heat exchanger.

Suitable conduit means are provided for circulating engine coolant water through the annular heat exchange passage 28 of the heat exchanger and through the cooling regions of the engine 74. Such conduit means comprises piping 82 extending between the outlet fitting 58 of the heat exchanger and the engine coolant water inlet 76. Such conduit means also comprises an expansion tank 84 mounted above the water cooling regions of the engine 74, a connection 86 extending between the engine coolant outlet 78 and an upper portion of expansion tank 84, and piping 88 extending between a drain connection 87 of expansion tank 84 and inlet fitting 54 of the heat exchanger. By this arrangement, this last-mentioned conduit means circulates the flow of engine coolant water from the engine 74 to expansion tank 84, through piping 88 into the heat exchanger, through the heat exchanger flow compartments for the liquid to be cooled and back to the engine by way of piping 82 and inlet 74. The expansion tank 84 functions to collect any air in the coolant system so that this air can not reduce the heat transfer action in the heat exchanger.

In the operation of the water pumping system shown in FIG. 6, the pump 70 draws water from the supply through the internal chamber 18 of the heat exchanger, this water serving as the cooling medium. At the same time, the engine water coolant is circulated through the annular heat exchange chamber 28 of the heat exchanger back and forth through the compartments 41, 42, 43 and 44 as described with respect to FIGS. 1–5 and back to the cooling regions of the engine 74, with the coolant water being cooled by the main pump water flowing through the heat exchanger.

I claim:

1. A heat exchanger comprising:

an elongated body having an inlet opening at one end thereof and a discharge opening at the other end thereof, said body including a tubular portion extending between said inlet and discharge openings for defining a first heat exchange chamber internally thereof, a cover means spaced apart from and enclosing the exterior of said tubular portion to cooperate therewith to define a second heat exchange chamber, inlet means through which a liquid to be cooled may be supplied to said second heat exchange chamber, and outlet means through which a liquid to be cooled may be discharged from said second heat exchange chamber, said tubular portion having fin means providing an extended surface for effective heat exchange action, said fin means being located on both sides of said tubular portion to extend into both of said first and second heat exchange chambers, said fin means including a plurality of fins extending generally longitudinally of said tubular portion on both the inside and the outside thereof, said outside fins cooperating with said cover and said tubular portion to define a plurality of longitudinally extending conduits in said second heat exchange chamber through which the liquid to be cooled flows as it passes through said heat exchanger, said tubular portion being provided with divider wall portions for dividing said second heat exchange chamber into a plurality of flow compartments extending longitudinally of said tubular portion and crossover ports providing flow communication between adjacent flow compartments, said crossover ports being located so that the liquid to be cooled flows in opposite directions in adjacent ones of said flow compartments, said divider wall portions dividing said second heat exchange chamber into four flow compartments, there being three crossover ports arranged at the ends of said flow compartments so that said liquid to be cooled makes four passes longitudinally back and forth along said tubular portion.

2. A heat exchanger according to claim 1 where said elongated body is made of a one-piece casting.

3. A heat exchanger according to claim 1 wherein said elongated body is made of a pair of castings, each forming half of said body.

4. A heat exchanger according to claim 1 wherein said fin means are made of aluminum.

5. A heat exchanger according to claim 1 wherein said fin means are made of a copper base alloy.

6. A heat exchanger according to claim 1 wherein the ratio of the length to the diameter of said elongated body is about $1\frac{1}{2}$ to 4.

* * * * *